US007118105B2

(12) United States Patent
Benevento

(10) Patent No.: US 7,118,105 B2
(45) Date of Patent: Oct. 10, 2006

(54) MINIATURE GOLF GAME

(76) Inventor: Mark Anthony Benevento, 44 Broadway, Somers Point, NJ (US) 08244

( * ) Notice: Subject to any disclaimer, the term of this patent is extended or adjusted under 35 U.S.C. 154(b) by 263 days.

(21) Appl. No.: 10/903,708

(22) Filed: Jul. 30, 2004

(65) Prior Publication Data

US 2005/0051951 A1 Mar. 10, 2005

Related U.S. Application Data

(60) Provisional application No. 60/491,158, filed on Jul. 30, 2003.

(51) Int. Cl.
*A63B 67/02* (2006.01)
*A63F 1/18* (2006.01)

(52) U.S. Cl. ..... 273/121 B; 273/108.2; 273/119 R; 273/118 R; 273/108; 473/150

(58) Field of Classification Search ..... 273/108, 273/108.2, 118 R, 118 A, 119 R, 119 A, 273/120 R, 120 A, 121 R, 121 A; 473/150, 473/151, 157, 173
See application file for complete search history.

(56) References Cited

U.S. PATENT DOCUMENTS 524,475 A 8/1894 Wheeland
1,947,772 A 2/1934 Harris
3,986,718 A 10/1976 Long et al.
4,272,001 A 6/1981 Horniak
4,327,917 A * 5/1982 Bagley ..... 473/153
4,460,177 A * 7/1984 Slayton ..... 473/185
5,016,879 A 5/1991 Parker et al.
5,833,104 A 11/1998 Horniak et al.
6,299,164 B1 * 10/2001 Yi ..... 273/126 A
6,398,219 B1 6/2002 Pierce et al.
2005/0051951 A1 * 3/2005 Benevento ..... 273/120 R

* cited by examiner

*Primary Examiner*—Raleigh W. Chiu
(74) *Attorney, Agent, or Firm*—Synnestvedt & Lechner LLP; Gregory S. Bernabeo

(57) ABSTRACT

A miniature golf game involving a miniature golf hole having a playing surface including a tee-off area and a ball-receiving cup. The hole includes a pachinko game or other game of chance, which may be positioned within the playing surface or otherwise adjacent the cup. The game of chance is operable to select one a predetermined plurality of prizes. The player putts the golf ball along the playing surface and into the cup. The game of chance is operated to select a prize for award to the player. The travel of the ball within the game of chance may determine the selection of the prize. Such operation may occur automatedly or manually in response to receipt of the ball in the cup. The player is awarded the prize selected by the game of chance. Prizes may be dispensed in an automated fashion, and may include a counter for accounting purposes.

30 Claims, 7 Drawing Sheets

MINIATURE GOLF GAME

CROSS-REFERENCE TO RELATED APPLICATION

This application claims the benefit of U.S. Provisional Patent Application No. 60/491,158, filed Jul. 30, 2003 the entire disclosure of which is hereby incorporated herein by reference.

FIELD OF THE INVENTION

The present invention relates generally to miniature golf courses, and more particularly to a miniature golf course including an attraction in the nature of a game of chance.

DISCUSSION OF THE RELATED ART

Miniature golf is a well-known game of skill that is enjoyed by children and adults alike. Miniature golf courses have a plurality of individual sequential "holes", each comprising a tee-off area (i.e. the designated starting point) and a recessed cup positioned at a distance from the tee-off area into which a player attempts to putt a golf ball to conclude play of the corresponding hole. Players are amused while testing their skill by completing the course using as few strokes as possible to putt the golf ball into the cup of each hole. Such courses usually challenge the putting skill of the players by the employment of elaborate contours, obstacles and the like, fixed in or movable into the golfer's putting line between the tee-off area and the cup. Players advance through the course by playing the several holes (generally 9 or 18) in a predetermined sequence, starting from the first tee-off area of the first hole, and ending by putting the ball into the cup of the last (usually ninth or eighteenth) hole, using a golf ball and golf club (i.e. putter) that are normally borrowed/rented from the miniature golf facility. After playing the last hole, players often return the borrowed ball and club to a clerk of the miniature golf facility. In certain embodiments, the hole is configured (e.g., to permit only a single putt towards a distant cup) to acknowledge a hole-in-one (e.g., with flashing lights, siren, etc.) and/or to recapture a ball whether or not the ball is received in the cup.

The clerk is often responsible for distributing prizes to the players upon return of any borrowed equipment and/or after completion of the golf course. For example, such prizes may include coupons for free games, free food and other concessions, discounts for games, food, etc., stuffed animals, and the like. Such prizes are often manually awarded by the clerk, e.g. upon the player's verbal report that the player achieved a "hole-in-one," etc. This approach relies upon the trustworthiness of the players and the clerk, which is sometimes less than optimal. Therefore, this approach lacks reliability. Additionally, manual awarding of prizes fails to provide an adequate accounting of games played, prizes distributed, free games outstanding, etc. which can complicate accounting and other aspects of management of the miniature golf facility.

SUMMARY OF THE INVENTION

The present invention combines a game of skill, namely miniature golf, with a game of chance. An exemplary miniature golf game includes a playing surface comprising a tee-off area and a cup for receiving a golf ball, and a game of chance operable to select one of a predetermined plurality of prizes for award to a player. The game of chance may include a pachinko game, a roulette-style rotatable wheel, or may have any other suitable configuration. Optionally, the game of chance is configured to automatedly dispense an appropriate prize.

A method for conducting a miniature golf game is provided. The method includes providing a playing surface comprising a tee-off area and providing a game of chance adjacent the tee-off area, the game of chance being operable to select one of a predetermined plurality of prizes. The method includes allowing a player to putt a golf ball along the playing surface to achieve a putting goal, operating the game of chance to select one of the predetermined plurality of prizes for award to a player, and awarding to the player the prize selected by the game of chance.

BRIEF DESCRIPTION OF THE DRAWINGS

The present invention will now be described by way of example with reference to the following drawings in which.

DETAILED DESCRIPTION

Figure 1:
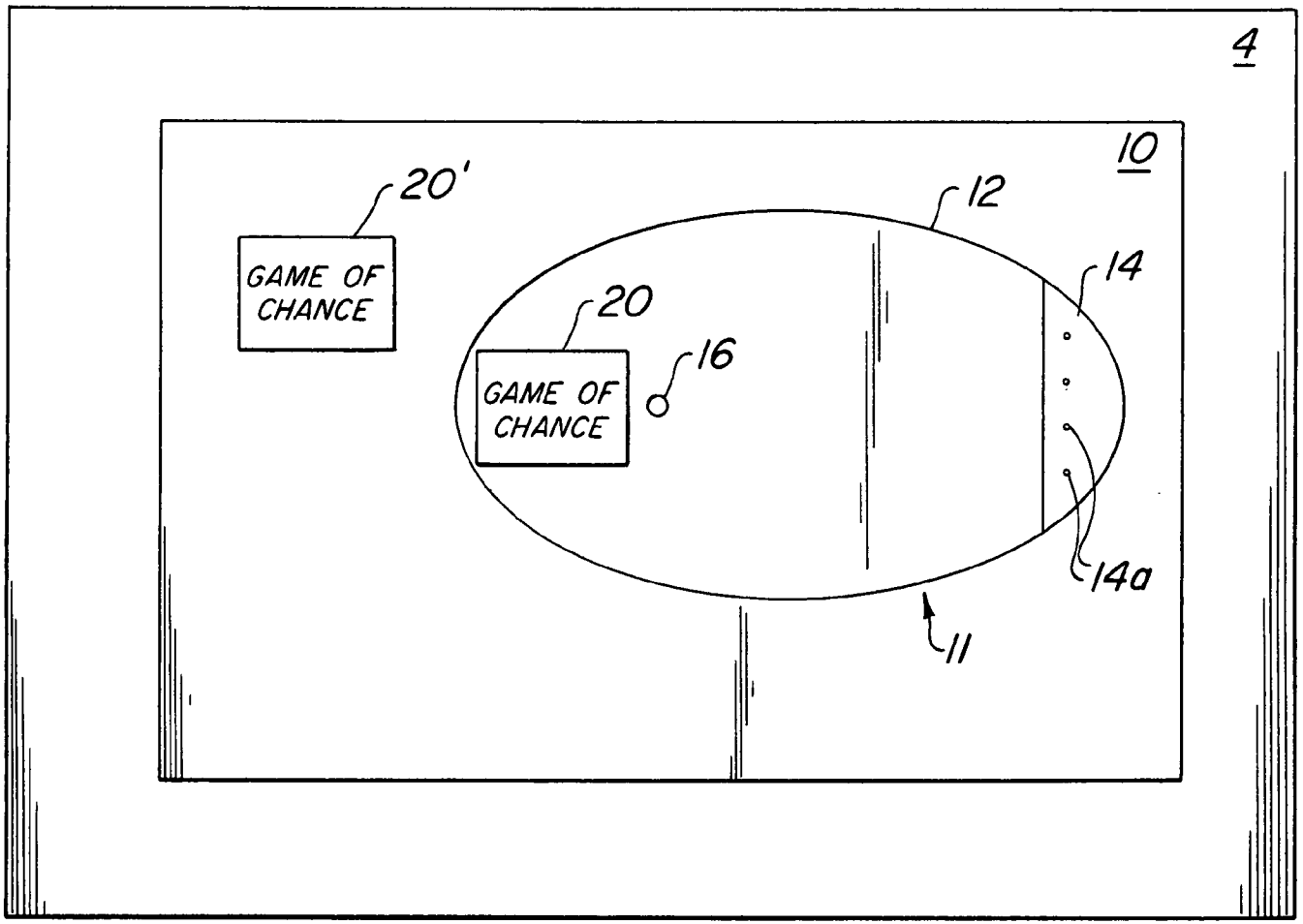
FIG. 1 is a plan view of an exemplary miniature golf facility.

The inventive miniature golf game may be understood with reference to the exemplary miniature golf facility 4 of FIG. 1. As shown in FIG. 1, the exemplary miniature golf facility 4 includes a miniature golf course 10. The miniature golf course 10 includes a series of miniature golf holes, e.g. 9 or 18. Each hole includes a playing surface 12 comprising a tee-off area 14 (see tees 14*a*) and a cup 16 for receiving a golf ball or other similar putting goal, such as a target, etc. In these respects the miniature golf facility, miniature golf course and miniature golf holes are similar to those well-known in the art and of a type that can be found in many resort or other areas.

In accordance with the present invention, at least one miniature golf hole includes a game of chance 20, as shown in FIG. 1 with reference to the exemplary golf hole 11. The game of chance 20 is positioned adjacent the cup 16 and/or tee-off area 14, either within the playing surface 12 as shown in FIG. 1, or alternatively outside the playing surface 12 but generally near tee-off area 14 and/or the cup 16 of the hole 11, as shown at 20'. More specifically, such a game of chance 20' may be positioned within the miniature golf course area 10, within the boundaries of the miniature golf facility 4 (i.e. on the premises of the miniature golf facility), or within 500 feet, or more preferably within 250 feet, of a tee off area 14 of the miniature golf hole 11.

The game of chance 20 may be any game of chance that is operable to select one of a predetermined plurality of prizes for award to a player such that the player of the game does not know the outcome (i.e. the selection of the prize)

before it occurs. Numerous different games of chance are known in the art and any suitable game of chance may be used. For example, the game of chance may include a roulette game, a slot machine, a rotatable prize wheel, an electronic device for randomly or algorithmically outputting a result, etc. Characteristic of such games of chance is that the player can do little if anything to ensure a certain result, although in some games of chance the player's actions may influence the result. Accordingly, the outcome of the game of chance is indeterminable by the player before the game is played, thereby creating a measure of suspense and exhilaration in the player in the hope of winning a desirable prize.

A further example of such games of chance is a pachinko ball-drop game. Pachinko games are also well known in the art. Exemplary pachinko games are disclosed in U.S. Pat. No. 524,475 to Wheeland, U.S. Pat. No. 1,947,772 to Harris, U.S. Pat. No. 5,016,879 to Parker et al. and U.S. Pat. No. 6,398,219 B1 to Pierce et al., the entire disclosures of each of which are hereby incorporated herein by reference. Generally, such pachinko games include an inclined (i.e., not horizontal, such as vertical or sloped) playing field having at least one opening at its upper end and a plurality of prize slots at its lower end. When a ball is dropped from the upper end, a prize selected for award is determined, at least in part, by the prize slot entered by the ball at the lower end of the playing field. The path that will be traveled by the ball is indeterminable, and is influenced as the ball travels down the playing field by deflection pins positioned on the board. Accordingly, the prize that will be awarded is indeterminable before the game is played.

Figure 2:
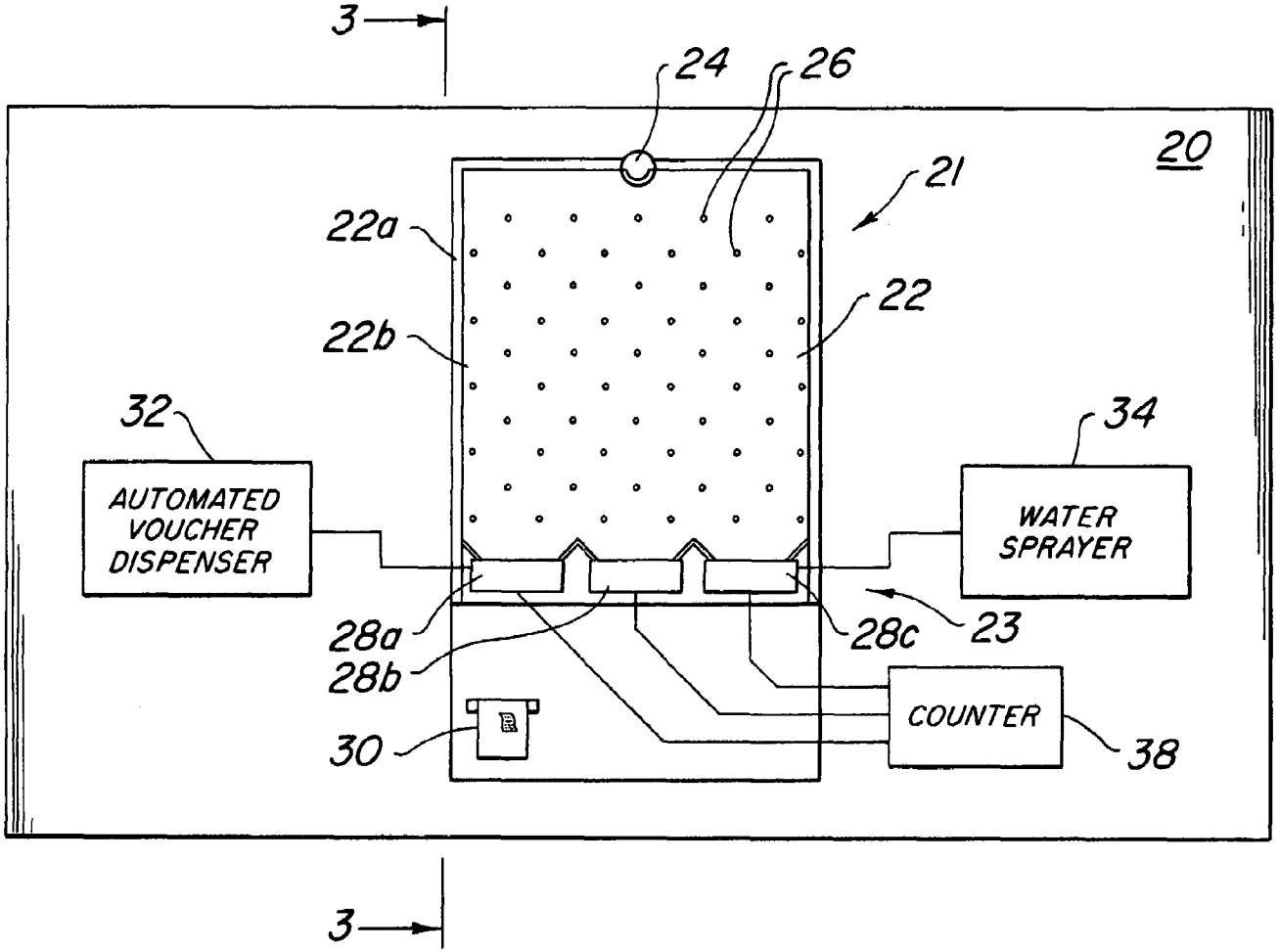
FIG. 2 is a schematic view of the game of chance of FIG. 1.
Figure 3:
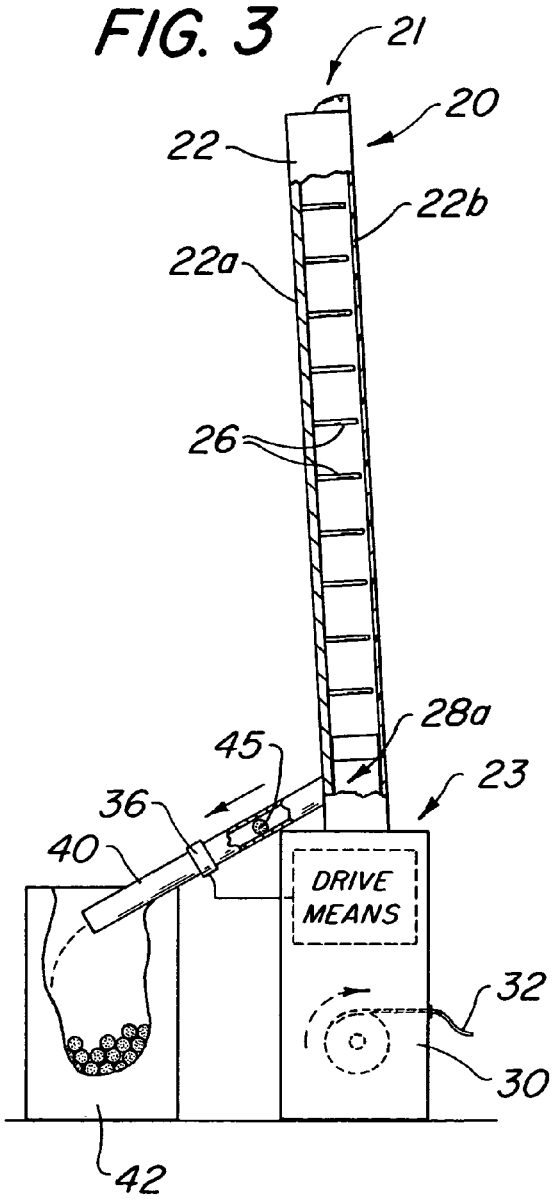
FIG. 3 is a cross-sectional view of the game of chance of FIG. 2, taken along line 3—3 of FIG. 2.

An exemplary game of chance 20 is shown in FIGS. 2 and 3. This exemplary game of chance 20 includes a pachinko-style playing field 22 having an opening 24 at its upper end 21 that is dimensioned to receive a golf ball. Deflection pins 26 are positioned on a back wall 22*a* of the playing field 22 and extend approximately to the front wall 22*b*. The deflection pins 26 are spaced on the back wall 22*a* to admit passage of the golf ball therebetween and to deflect the golf ball as it travels from the upper end 21 toward the lower end 23. The playing field 22 is inclined (substantially vertically in the example of FIG. 3) to cause the golf ball to fall by gravity into one of a plurality of prize slots 28*a*, 28*b*, 28*c* provided toward the lower end 23. In this embodiment, each of the prize slots 28*a*, 28*b*, 28*c* is associated with a predetermined prize. As used herein, the term "prize" includes not only conventional prizes, such as vouchers, coupons, food, drinks, stuffed animals, etc. but also includes undesirable "prizes," such as a spray of water, or no conventional prize at all. Accordingly, a player dropping his golf ball into the opening 24 at the upper end 21 of the playing field 22 will win the prize associated with the prize slot 28*a*, 28*b* or 28*c* entered by his ball at the lower end 23 of the board. In this manner, selection of a prize is determined by the ball's movement along the playing field 22. Other games of chance may be played in an appropriate fashion to select a prize.

In certain embodiments, the player may claim the prize from a clerk of the miniature golf facility, who manually awards the prize. In the exemplary embodiment of FIGS. 2 and 3, the game of chance is specially configured to provide for automated awarding of prizes. This eliminates concerns over human error or dishonesty of the players and/or clerk in claiming and/or awarding prizes. More specifically, the exemplary game of chance 20 includes an automated voucher dispenser 30 (shown schematically in FIG. 2) operatively connected to prize slot 28*a* for issuing a voucher 32 responsive to entrance of a respective prize slot by the golf ball. For example, an optical or mechanical sensor or switch (not shown) may be placed in the prize slot 28*a* to sense the presence of a ball therein, and thereby cause the dispenser 30 to issue a voucher 32. Alternatively, a ball 45 entering prize slot 28*a* may exit the playing field 22 via a chute 40 leading to a ball collection bin 42 and a similar sensor or switch 34 may be provided along the chute 40 to sense a ball therein and thereby cause the dispenser 30 to issue a voucher 32. Any suitable arrangement may be used to initiate dispensing of a voucher 32 upon entry of a ball in a corresponding prize slot, as will be appreciated by those skilled in the art. The voucher issued may be a free game ticket, free food ticket, discount coupon, point voucher, etc., as known in the amusement industry. By way of example, an automated ticket/voucher dispenser is disclosed in U.S. Pat. No. 4,272,001 to Horniak and U.S. Pat. No. 5,833,104 to Horniak et al., the entire disclosures of both of which are hereby incorporated herein by reference. Other suitable automated dispensers are available commercially, and any suitable automated dispenser may be used.

The exemplary game of chance 20 of FIG. 2 further includes a water sprayer 34 capable of spraying water (shown schematically in FIG. 2). The water sprayer 34 is operatively connected to prize slot 28*c* for spraying water responsive to entrance of a respective prize slot by the golf ball. For example, the water sprayer may include a pump (not shown) connected to a water source (not shown) and in fluid communication with a nozzle (not shown) directed toward a location likely occupied by a player while playing the game of chance 20. Suitable water sprayers and/or components thereof are commercially available and any suitable equipment may be used, as will be appreciated by those skilled in the art. A similar sensor/switch 36, chute 40, collection bin 42, etc. as disclosed above in reference to the automated voucher dispenser 30 may be used to cause the pump to spray water on the player when the player's ball enters the corresponding prize slot 28*c*. Accordingly, the "prize" awarded is a spray of water. In this exemplary embodiment, no conventional prize is awarded responsive to the ball's entry of prize slot 28*b*.

The exemplary game of chance 20 of FIG. 2 further includes a counter 38 operatively connected to at least one of the prize slots for counting a number of golf balls having entered a respective prize slot. As shown in FIG. 2, the exemplary counter 38 is operatively connected to each of the three prize slots 28*a*, 28*b*, 28*c* and is configured to count the number of balls entering each prize slot. This is useful for providing information such as the total number of games played, the total number of awards of each type of prize, etc., which is helpful for accounting and management purposes. The counter 38 may include sensors, switches, chutes, etc., as discussed above to trigger augmentation of a tally maintained by the counter 38. Any suitable commercially available counter/switch, etc. hardware may be used, as will be appreciated by those skilled in the art.

Optionally, the chute(s) and/or collection bin may be maintained in a limited access area, e.g., a padlocked cabinet, to prevent a player from retrieving a ball. In this manner, each player's ball may be recaptured by the golf course facility at the end of the miniature golf course to prevent replaying of the game of chance or any of the holes of the miniature golf course, thereby reducing loss of balls, loss of fees for playing the golf course, or loss of prizes that are not won during a player's first play of the game of chance.

Figure 4:
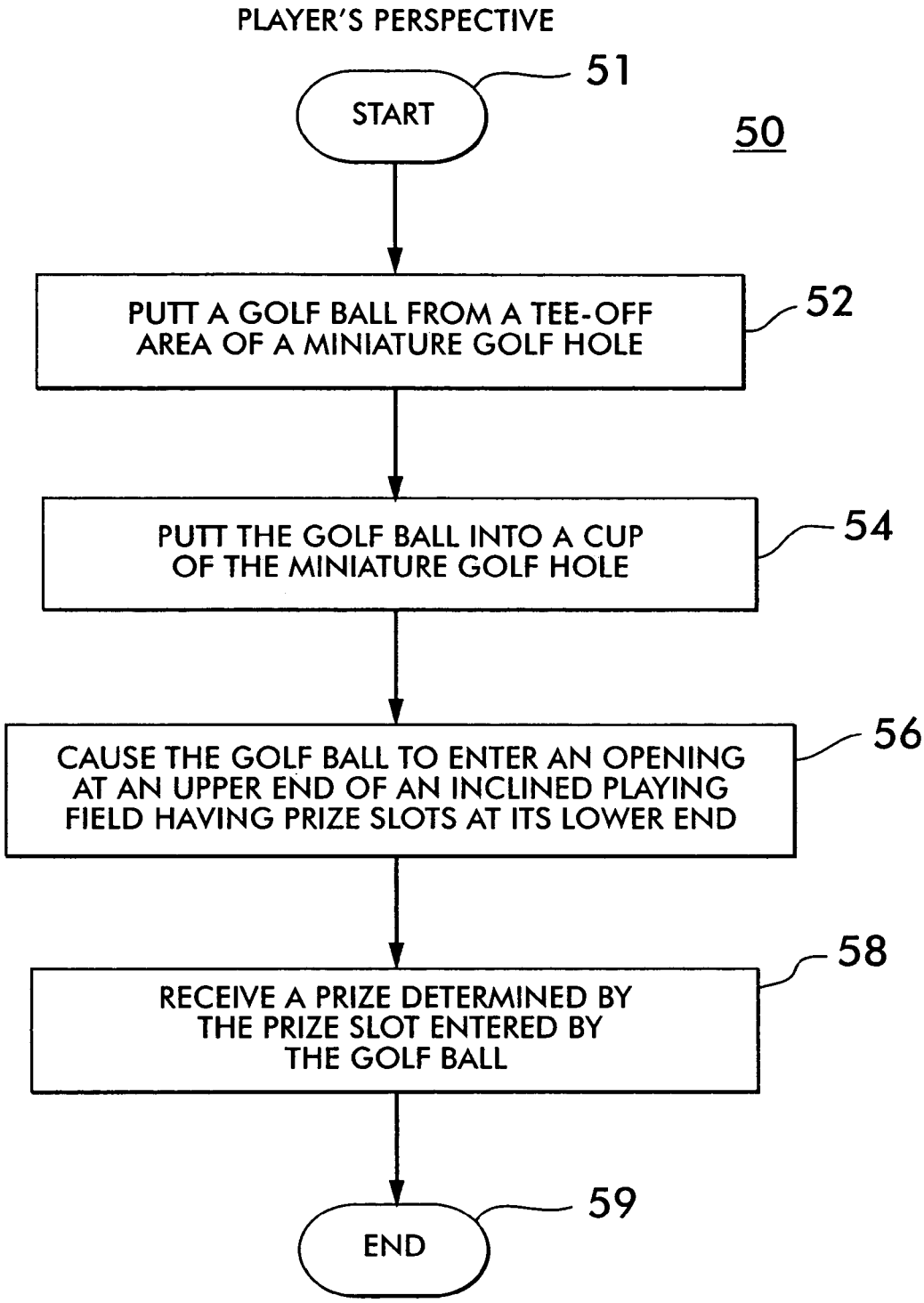
FIG. 4 is a flow diagram of an exemplary method of playing a miniature golf game.

FIG. 4 is a flow diagram 50 of an exemplary method of playing a miniature golf game, e.g. on the miniature golf course hole and game of chance of FIGS. 1 and 2. Referring now to FIGS. 1 and 4, the method starts with the player's putting of a golf ball from a tee-off area 14 of a miniature golf hole 11, as shown at steps 51 and 52. The method continues with the player's putting of the golf ball into the cup 16 of the miniature golf hole 11 or putting the golf ball to otherwise achieve a putting goal, e.g. climbing a ramp, striking a target, etc., as shown at step 54. This may be performed using the same stoke as in step 52 or a subsequent stroke. These steps allow for completion of the skill-based portion of play of the miniature golf hole.

The player then causes the golf ball to enter the opening 24 at the upper end 21 of the inclined playing field 22 (FIG. 2), as shown at step 56. For example, this may be achieved by putting the golf ball into the cup 16, manually removing the golf ball from the cup 16, and manually inserting the golf ball into the opening 24 of the playing field 22. For example, this may be appropriate for a golf hole 11 in which the game of chance 20' is located outside of the playing surface 12, or where the game of chance 20 is located within the playing surface 12 but its opening is not in communication with the cup 16. Other manually operated games of chance may be manually operated in an appropriate manner, by the player or the clerk, e.g., to spin a roulette or prize wheel, etc. In this arrangement, the player completes putting play of the miniature golf hole in a conventional manner, and subsequently plays the game of chance.

Alternatively, step 56 may be achieved by simply putting the golf ball into the cup 16 if the cup is in communication with the opening 24 of the playing field 22 such that the golf ball is thereby caused to move in an automated fashion from the cup 16 to the opening 24. For example, this may occur by gravity or otherwise as discussed above with reference to FIG. 3. Alternatively, putting the golf ball into the cup or otherwise achieving a putting goal may automatedly initiate play of the game of chance, which may not involve use of the golf ball at all, e.g. by tripping a switch to initiate operation of the game of chance. In this arrangement, the game of chance is integrated into the putting play of the miniature golf hole, such that completion of the skill-based putting play automatically initiates play of the game of chance. Alternatively, the hole may be configured such that all golf balls, whether entering the cup or not, enter the game of chance, or initiate play of the game of chance.

The method ends with the player's receipt of the prize selected by the game of chance. In the example above in which the game of chance includes a pachinko game, this is determined by the prize slot 28*a*, 28*b* or 28*c* entered by the player's golf ball at the lower end 23 of the playing field 22, as shown at steps 58 and 59. The particular prize slot entered for a given ball is a matter of chance, and so the player of the hole/game of chance remains in suspense until the player's ball enters a prize slot. For example, step 58 may involve receiving a prize manually distributed by a clerk. Alternatively, this step may involve receiving a prize dispensed in an automated fashion, e.g. a voucher 32 distributed by the automated voucher dispenser 30 (see FIG. 3) or a spray of water from the water sprayer 34 of FIG. 2.

Figure 5:
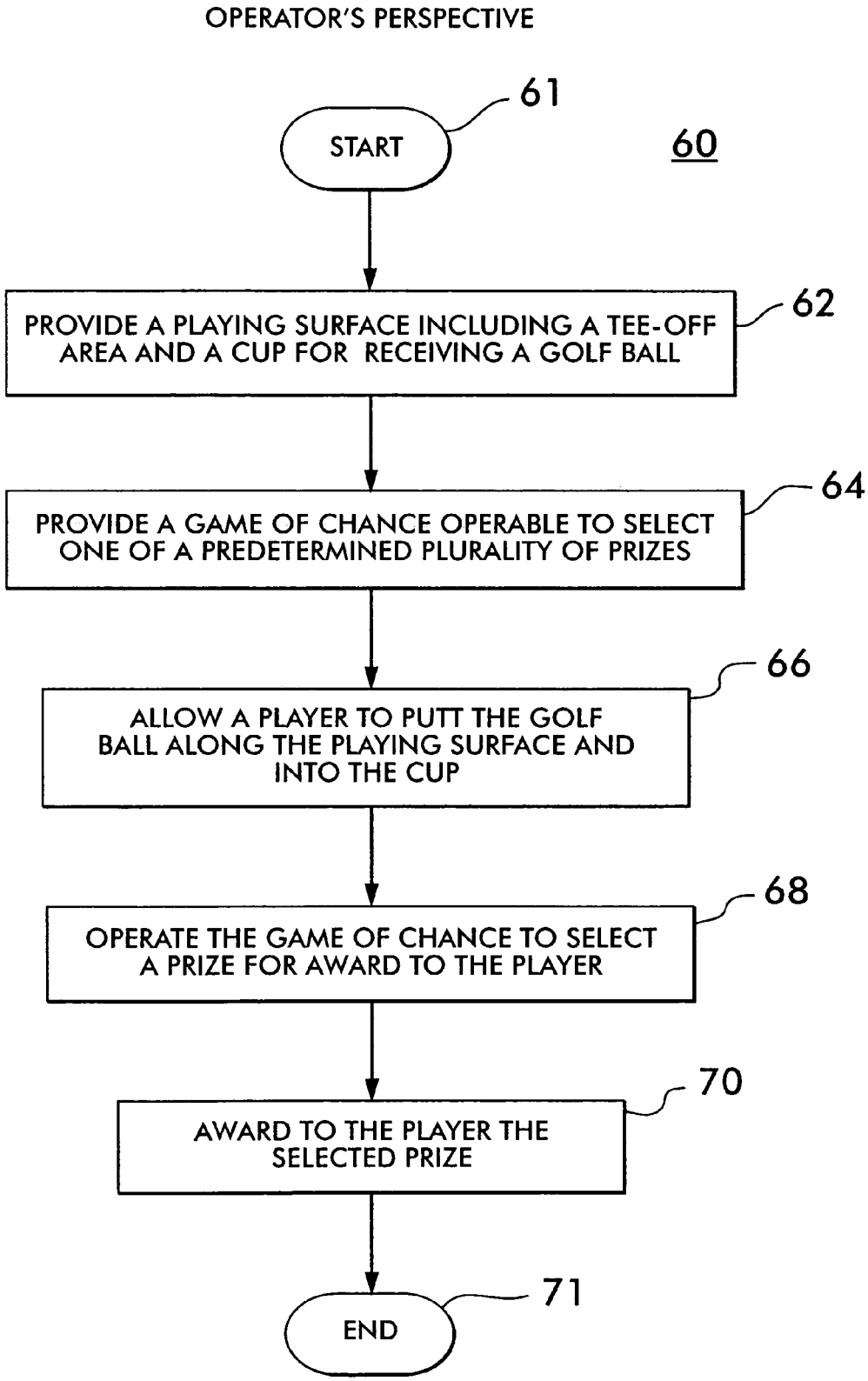
FIG. 5 is a flow diagram of an exemplary method of conducting a miniature golf game.
Figure 6:
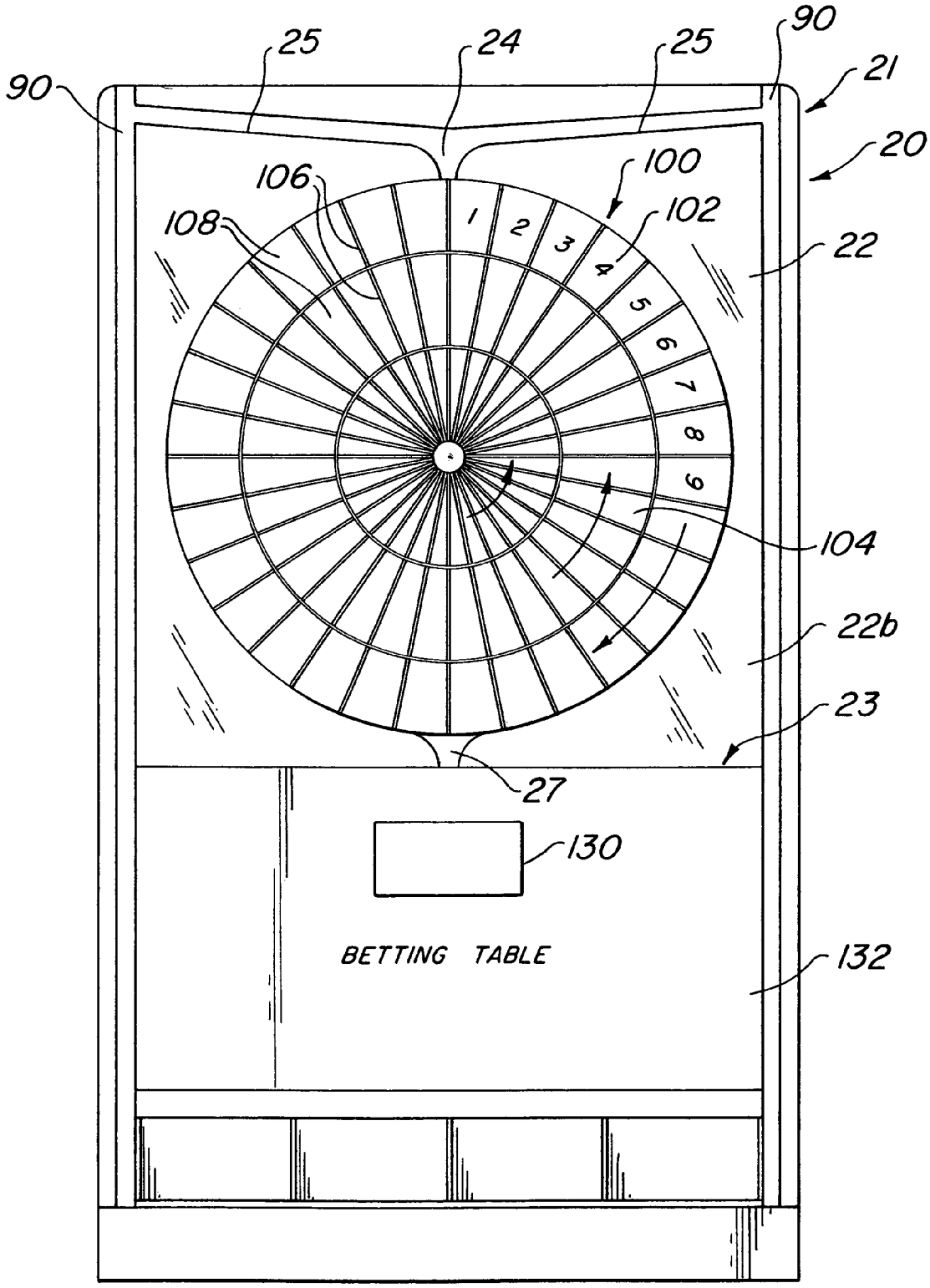
FIG. 6 is a front view of an alternative miniature golf hole.

FIG. 5 illustrates a flow diagram 60 of an exemplary method of conducting a miniature golf game, shown from the miniature golf facility's operator's perspective. Referring now to FIGS. 1 and 5, the method begins with providing a playing surface 12 comprising a tee-off area 14 and a cup 16 for receiving a golf ball, as shown at steps 61 and 62. The operator further provides a game of chance 20 operable to select one of a predetermined plurality of prizes, as shown at step 64 and discussed above. Next, the player is allowed to putt the golf ball along the playing surface 12 and into the cup 16, as shown at step 66. The operator then operates the game of chance 20 to select a prize for award to a player, as shown at step 68. Any game of chance may be employed, as discussed above. Operation of the game may be automatedly initiated by receipt in the cup of the player's golf ball, or may be manually or otherwise initiated. Finally, the operator awards the selected prize to the player, as shown at steps 70 and 71. The awarding of the prize may occur in a manual fashion (e.g., by distribution from a clerk) or in an automated fashion (e.g., by distribution from an automated voucher dispenser, water sprayer, etc.), as discussed above.

Figure 7:
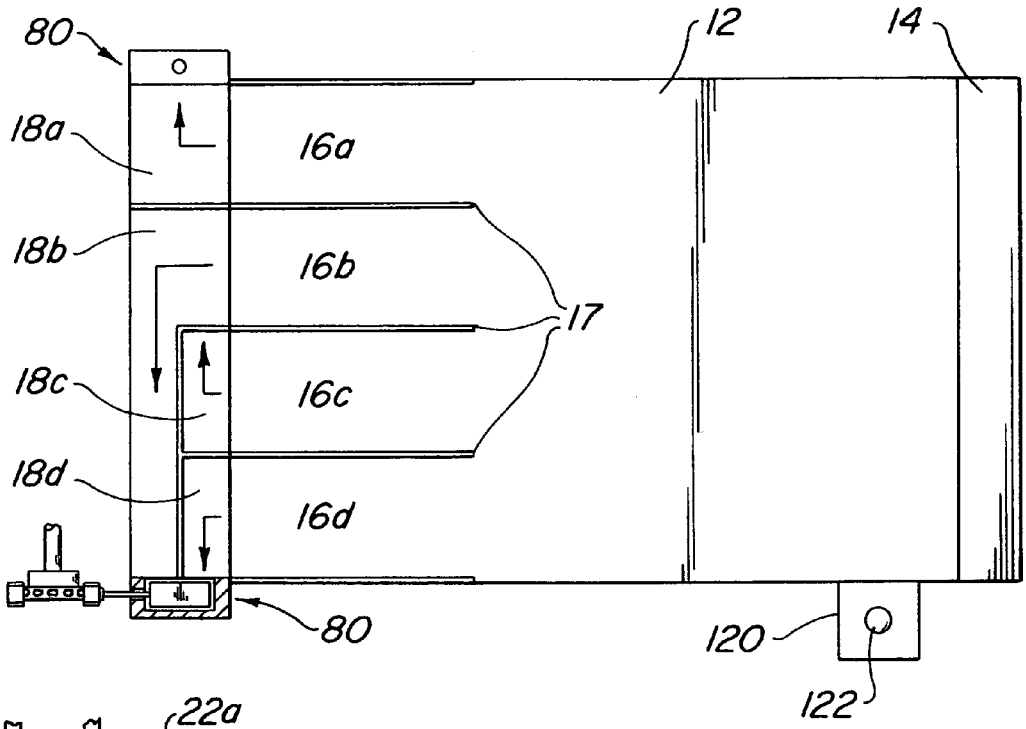
FIG. 7 is a top view of the miniature golf hole of FIG. 6.

FIGS. 6–9 show an alternative miniature golf hole 11 including an alternative game of chance 20 in the nature of a roulette wheel. As best shown in FIG. 7, the miniature golf hole 11 includes a playing surface 12, a tee-off area 14 and putting goals 16*a*, 16*b*, 16*c*, 16*d*. The playing surface 12 slopes downwardly from the tee-off-area 14 to facilitate a golf ball's entry of one of the putting goals. The putting goals are separated by walls 17 to direct a ball toward a corresponding ramp 18*a*, 18*b*, 18*c*, 18*d* that directs the ball to a conveyor 80 for lifting the ball from the playing surface area to an opening 24 toward the top end 21 of the game of chance 20. The conveyor 80 causes any golf ball entering one of the putting goals to move in an automated fashion from the putting goal 16*a*, 16*b*, 16*c*, 16*d* to the opening 24. In this manner, the putting goals (i.e. "cup") are in communication with the opening 24 of the playing field 22.

Figure 9:
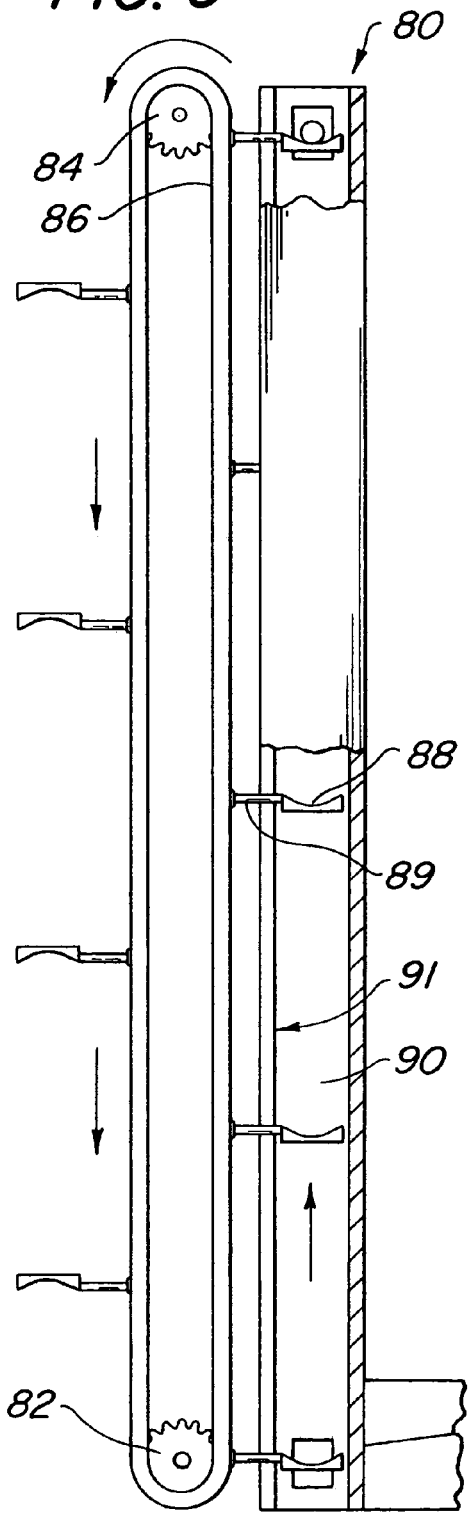
FIG. 9 is a side view of the conveyor of the miniature golf hole of FIG. 6.
Figure 8:
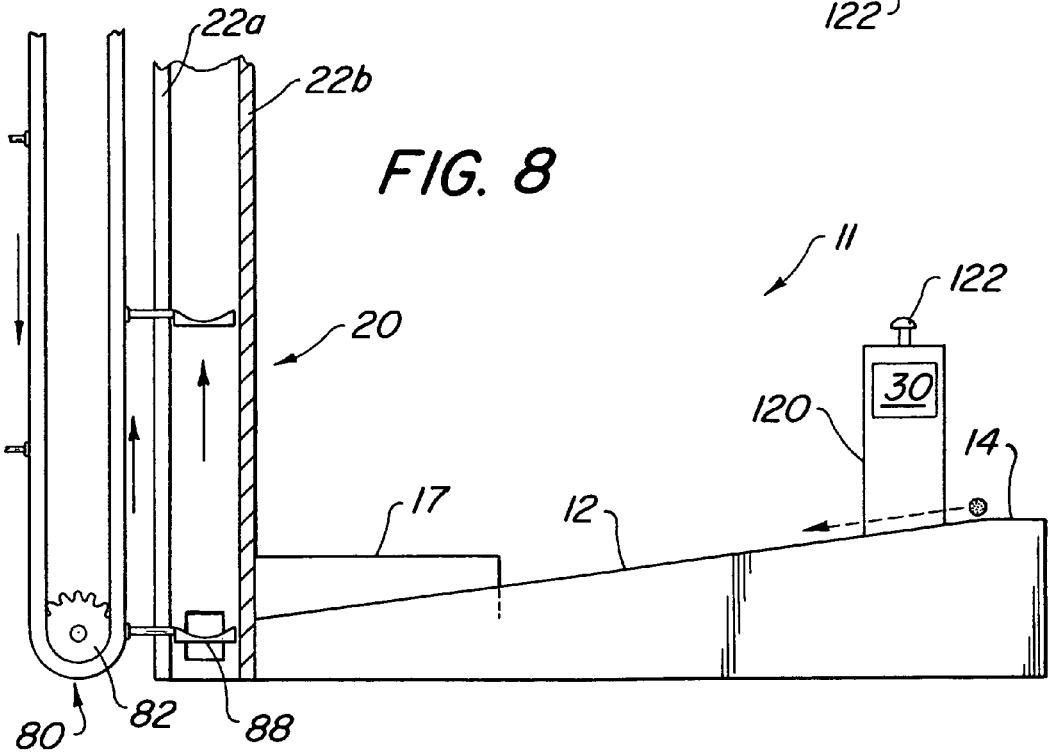
FIG. 8 is a partial side view of the miniature golf hole of FIG. 6.

The conveyor 80 includes upper and lower motor-driven sprockets 82, 84, and a chain, belt, etc. 86 driven by the sprocket(s) and supporting cups 88 for carrying a golf ball received by gravity from a respective ramp 18*a*, 18*b*, 18*c*, 18*d* (see FIGS. 8 and 9). The cups 88 travel vertically within a channel 90 having a slot 91 for admitting passage of a cup-supporting arm 89. The cups 88 release a carried ball near the top 21 of the game of chance 20 to cause the ball to exit the channel 90 and travel a downward sloping ramp 25 toward the opening 24 (see FIG. 6). For example, the cup 88 may be pivotally mounted on the arms 89, and may be caused to tip when the y reach a top of the channel 90 to cause release of a carried ball onto the ramp 25. Alternatively, each cup 88 may be shaped with inclined surfaces to call a ball to roll from the cup on to the ramp 25, the ball being prevented from exiting the cup 88 by a sidewall of the channel 90 until an opening is reached near the top of the channel 90. The ball then travels by gravity onto the playing field 22 of the game of chance 20. A similar conveyor 80 may be provided on the opposite side of the game of chance 20 for receiving balls from corresponding ramps 18*a*, 18*c* (see FIG. 7).

The playing field 22 of the game of chance of FIGS. 6–9 includes a roulette style wheel 100 rotatably supported thereon. The wheel is motorized and is operatively connected to a switch and power source to cause the wheel to spin upon entry of a ball in one of the putting goals 16*a*–16*d*, in the opening 24, etc. In this particular embodiment, the wheel 100 includes two segments 102, 104 configured to rotate in opposite directions about a central hub 106. The outer wheel 102 includes numbered segments and the inner wheel 104 includes colored (e.g. red and black) segments, similar to a conventional roulette wheel. The rotation of the wheels 102, 104 causes a ball entering the opening 24 to be bounced about in an indeterminable pattern. The spinning wheels 102, 104 have ribs/ridges 106 and/or angled surfaces 108, etc. to catch and deflect the ball and prevent the ball from dropping directly from the opening 24 to a lower end 23 of the game of chance 20.

A pedestal 120 near the tee-off area 14 may be provided with a button 122 operatively connected to the motor(s) driving the wheels 102, 104 to allow the player to selectively stop rotation of the wheels 102, 104 at a desired point in time (see FIG. 8). The game of chance 20 may be further configured with a timer to stop rotation of the wheels if the player does not depress the button 122 within a predetermined time period. When the wheels stop, the ball moves toward the lower end 23 of the playing field 22 by gravity and exits via an exit hole 27 where it is collected for storage, etc. The segments of the inner and outer 104, 102 wheels nearest the exit hole 27, or the segments through which the ball passes to enter the exit hole 27, is determined as the "winning" number/color combination. Optionally, the winning combination may be displayed on a computerized, electronic and/or lighted display 130 of the betting table 132. Depending upon the odds, etc. this may result in the award of a greater or lesser number of points, tickets, vouchers, etc., which are optionally automatedly dispensed from an automated voucher dispenser 30 housed within the pedestal 120. The vouchers may be used to claim prizes from a clerk or vending machine. Alternatively, the vouchers may be used as input to another game of chance, e.g. another game of chance of another miniature golf hole. For example, a voucher acceptor may be provided to accept the vouchers, etc. as tokens, etc. for playing and/or wagering on a subsequent game of chance. In this manner, a wagering game may be played among one or more games of chance, and one or more miniature golf holes. This further integrates the game of skill (miniature golf) with games of chance (roulette, etc.). It will be appreciated that numerous variations of games of chance may be employed.

In other embodiments, other devices, mechanisms or techniques, either powered or non-powered, may be used to automatedly transport the ball into the opening 24 so that the player need only putt the golf ball into the cup 16/putting goal 16*a*, 16*b*, 16*c*, 16*d* to initiate operation of the game of chance to select a prize. Accordingly, operation of the game of chance, and selection of a prize for award to a player, is initiated by receipt in the cup of the player's golf ball.

By way of further illustration, a combined game of skill and chance in accordance with the present invention may include a miniature golf hole including a tee-off area and one or more cups or other putting goals (e.g., targets). The miniature golf hole may further include a game of chance, such as a slot machine, which may be located within or outside the playing surface of the hole. In accordance with the present invention, the miniature golf hole is specially configured with switches, sensors, etc. to determine which cup is entered by a player's golf ball, or which putting goal is achieved (e.g. by sensing the ball's presence, path, etc. relative to the hole). Additionally, the game of chance is operatively connected to such switches, sensors, etc. to provide a more or less favorable outcome as a result of the play of the game of chance as a function of the cup/putting goal achieved by the player while playing the miniature golf hole. For example, entry of a player's ball in a cup that requires a very skillful putt may increase the prize(s) that may be awarded to a player upon play of the game of chance, or may increase the player's chance of winning when playing the game of chance, etc. Similarly, entry of a player's ball in a cup that requires a less skillful putt may provide for a smaller prize, or smaller odds of winning a prize. By way of illustration, the game of chance may be a slot machine of a type generally known in the art, which provides for awarding of prizes when one or more sequences of images are displayed in a "line" across the slot machine wheels. The slot machine may be operatively connected to the holes/putting goals of the miniature golf game such that making an easy putt allow the player to win when the sequences of images displayed on the wheels appear on one line. The slot machine may be further operatively connected to the holes/putting goals of the miniature golf hole such that making a difficult putt allows the player to win when the sequences of images displayed on the wheels appears on any one of multiple lines (multiple rows, diagonally, etc.). Accordingly, the player's success or skill demonstrated in playing the game of skill (miniature golf) affects the awarding of prizes in playing the game of chance; i.e. the play and/or awarding of prizes upon play of the game of chance is varied as a function of the player's achievement of a respective one of a plurality of putting goals, or otherwise as a function of a player's skill demonstrated in playing a respective miniature golf hole. Any suitable game of chance, logic for awarding prizes based on achievement of putting goals, etc. may be provided, as will be appreciated by those skilled in the art. Accordingly, a game is provided in which a player's demonstrated skill in playing a game of skill (miniature golf) impacts the playing of a game of chance, e.g. by affecting a potential or awarded prize, or a likelihood of winning such a prize.

Accordingly, the present invention combines a game of skill (miniature golf) with a game of chance (pachinko, roulette, etc.), and thereby enhances the miniature golf experience. The combination of the game of chance with the game of skill enhances the excitement for a player of the game of skill because it provides an indeterminable outcome. Additionally, the player may be rewarded (or potentially rewarded) in playing the game of chance as a function of the player's demonstrated skill in playing the game of skill.

Having thus described particular embodiments of the invention, various alterations, modifications, and improvements will readily occur to those skilled in the art. Such alterations, modifications and improvements as are made obvious by this disclosure are intended to be part of this description though not expressly stated herein, and are intended to be within the spirit and scope of the invention. Accordingly, the foregoing description is by way of example only, and not limiting. The invention is limited only as defined in the following claims and equivalents thereto.

What is claimed is:

1. A method for conducting a miniature golf game comprising:

providing a playing surface comprising a tee-off area;

providing a game of chance adjacent the tee-off area, the game of chance being operable to select one of a predetermined plurality of prizes;

allowing a player to putt a golf ball along the playing surface to achieve a putting goal;

operating the game of chance to select one of the predetermined plurality of prizes for award to a player; and awarding to the player the prize selected by the game of chance.

2. The method of claim 1, wherein the operating step is performed in response to achievement of the putting goal.

3. The method of claim 2, the playing surface further comprising a cup for receiving a golf ball, wherein achievement of the putting goal comprises putting the golf ball into the cup, and wherein the operating step is automatedly initiated in response to receipt in the cup of the player's golf ball.

4. A method for playing a miniature golf game, the method comprising:

putting a golf ball from a tee-off area of a miniature golf hole; and causing the golf ball to enter an opening at an upper end of a playing field having a plurality of prize slots at its lower end, the playing field being inclined to cause the golf ball to fall by gravity from the upper end into one of the plurality of prize slots.

5. The method of claim 4, wherein the playing field comprises a plurality of deflection pins spaced to admit passage of the golf ball therebetween and positioned to deflect the golf ball as it travels from the upper end toward the lower end.

6. The method of claim 5, wherein the playing field comprises a back wall and a front wall, and the plurality of deflection pins are disposed on the back wall and extend approximately to the front wall.

7. The method of claim 4, wherein causing the golf ball to enter the opening comprises:

putting the golf ball into a cup of the miniature golf hole;

manually removing the golf ball from the cup; and manually inserting the golf ball into the opening of the playing field.

8. The method of claim 4, wherein the miniature golf hole comprises a cup for receiving the golf ball that is in communication with the opening of the playing field, and wherein causing the golf ball to enter the opening comprises putting the golf ball into the cup, the golf ball being thereby caused to move in an automated fashion from the cup to the opening.

9. The method of claim 4, wherein each of the plurality of prize slots is associated with a predetermined prize.

10. The method of claim 4, further comprising receiving the prize associated with a prize slot entered by the golf ball.

11. The method of claim 10, wherein receiving the prize comprises receiving a voucher from an automated dispenser.

12. The method of claim 10, wherein receiving the prize comprises being sprayed with water.

13. A miniature golf hole comprising:

a playing surface comprising a tee-off area and a cup for receiving a golf ball;

an inclined playing field having at least one opening at its upper end and a plurality of prize slots at its lower end, the opening being dimensioned to receive the golf ball, the playing field being inclined to cause the golf ball to fall by gravity into one of the plurality of prize slots.

14. The miniature golf hole of claim 13, wherein the inclined playing field is positioned adjacent the cup within the playing surface.

15. The miniature golf hole of claim 13, wherein the cup is in communication with the opening of the playing field to cause any golf ball entering the cup to move in an automated fashion from the cup to the opening.

16. The miniature golf hole of claim 13, wherein the playing field comprises a plurality of deflection pins spaced to admit passage of the golf ball therebetween and positioned to deflect the golf ball as it travels from the upper end toward the lower end.

17. The miniature golf hole of claim 16, wherein the playing field comprises a back wall and a front wall, and the plurality of deflection pins are disposed on the back wall and extend approximately to the front wall.

18. The miniature golf hole of claim 13, wherein each of the plurality of prize slots is associated with a predetermined prize.

19. The miniature golf hole of claim 13, further comprising an automated dispenser operatively connected to at least one of the prize slots for issuing a voucher responsive to entrance of a respective prize slot by the golf ball.

20. The miniature golf hole of claim 13, further comprising a water sprayer capable of spraying water, the water sprayer being operatively connected to at least one of the prize slots for spraying water responsive to entrance of a respective prize slot by the golf ball.

21. The miniature golf hole of claim 13, further comprising a counter operatively connected to at least one of the prize slots for counting a number of golf balls having entered a respective prize slot.

22. A miniature golf game comprising:

a playing surface comprising a tee-off area and a cup for receiving a golf ball; and, a game of chance adjacent to the tee-off area and operable to select one of a predetermined plurality of prizes for award to a player upon receipt of the golf ball in the cup.

23. The game of claim 22, wherein the selection is automatedly initiated by receipt in the cup of the player's golf ball.

24. The game of claim 22, wherein the game of chance comprises a pachinko game.

25. The game of claim 24, wherein the pachinko game is capable of receiving the golf ball, the prize being selected as a function of a prize slot of the pachinko game that is entered by the golf ball.

26. The game of claim 24, wherein the game of chance comprises an inclined playing field having at least one opening at its upper end and a plurality of prize slots at its lower end, the opening being dimensioned to receive the golf ball, the playing field being inclined to cause the golf ball to fall by gravity into one of the plurality of prize slots.

27. The game of claim 23, wherein the selection of one of the predetermined plurality of prizes for award to a player is determined by a trajectory of a ball across a playing field.

28. The game of claim 23, wherein the game of chance comprises a rotatable wheel.

29. A method for conducting a miniature golf game comprising:

providing a playing surface comprising a tee-off area;

providing a game of chance adjacent the tee-off area, the game of chance being operable to select one of a predetermined plurality of prizes;

allowing a player to putt a golf ball along the playing surface to achieve one of a plurality of putting goals;

operating the game of chance to select one of the predetermined plurality of prizes; and awarding to the player a prize, the prize awarded being determined according to the prize selected by the game of chance and the player's achievement of a respective one of the plurality of putting goals.

30. A method for conducting a miniature golf game comprising:

providing a playing surface comprising a tee-off area;

providing a game of chance adjacent the tee-off area, the game of chance being operable to select one of a predetermined plurality of prizes;

allowing a player to putt a golf ball along the playing surface to achieve one of a plurality of putting goals;

operating the game of chance to select one of the predetermined plurality of prizes for award to a player; and awarding to the selected prize, the odds of winning when playing the game of chance being varied as a function of the player's achievement of a respective one of the plurality of putting goals.

* * * * *